US012179974B2

(12) United States Patent
Hu

(10) Patent No.: US 12,179,974 B2
(45) Date of Patent: Dec. 31, 2024

(54) CONTAINER LID WITH TWO DRINKING OPENINGS

(71) Applicant: ZHEJIANG FLY CUP CO., LTD, Jinhua (CN)

(72) Inventor: Feipeng Hu, Yongkang (CN)

(73) Assignee: ZHEJIANG FLY CUP CO., LTD, Jinhua (CN)

( * ) Notice: Subject to any disclaimer, the term of this patent is extended or adjusted under 35 U.S.C. 154(b) by 0 days.

(21) Appl. No.: 18/760,176

(22) Filed: Jul. 1, 2024

(65) Prior Publication Data

US 2024/0351758 A1 Oct. 24, 2024

(30) Foreign Application Priority Data

Mar. 15, 2024 (CN) ..... 202420502723.0

(51) Int. Cl.

| | |
|---|---|
| ***A47G 19/22*** | (2006.01) |
| ***B65D 47/08*** | (2006.01) |
| ***B65D 51/24*** | (2006.01) |
| ***B65D 55/12*** | (2006.01) |

(52) U.S. Cl.

CPC ..... *B65D 51/246* (2013.01); *A47G 19/2222* (2013.01); *B65D 47/0857* (2013.01); *B65D 55/12* (2013.01)

(58) Field of Classification Search

CPC ..... A47G 19/2222; A47G 19/2211; A47G 19/2205; B65D 47/0857; B65D 55/12

USPC ..... 220/708, 709

See application file for complete search history.

(56) References Cited

U.S. PATENT DOCUMENTS

| | | | | |
|---|---|---|---|---|
| 10,004,348 | B2 * | 6/2018 | Sorensen | A47G 19/2266 |
| 11,390,432 | B2 * | 7/2022 | Li | F16C 11/045 |
| 2021/0085104 | A1 * | 3/2021 | Pinelli | B65D 47/32 |
| 2023/0365307 | A1 | 11/2023 | Hernandez Rodriguez et al. | |
| 2024/0092543 | A1 | 3/2024 | Li | |
| 2024/0159442 | A1 | 5/2024 | Gormley et al. | |

* cited by examiner

*Primary Examiner* — Stephen J Castellano

(74) *Attorney, Agent, or Firm* — Hemisphere Law, PLLC; Zhigang Ma

(57) ABSTRACT

The present disclosure belongs to the technical field of cups, and in particular, to a container lid with two drinking openings, including: a lid body, which is configured to be attached to a container main body; a direct drinking opening, which is arranged on the lid body, wherein the direct drinking opening is communicated to the container main body, and a material stored in the container main body is directly drunk through the direct drinking opening; a straw opening, which is arranged on the lid body; a straw, which is movably arranged in the straw opening; a closure member, which is movably connected to the lid body; a button, which is movably connected to the lid body, wherein the button can move between a locked position and an unlocked position relative to the lid body and the closure member.

15 Claims, 14 Drawing Sheets

CONTAINER LID WITH TWO DRINKING OPENINGS

TECHNICAL FIELD

The present disclosure belongs to the technical field of cups, and in particular, to a container lid with two drinking openings.

BACKGROUND

A cup is a tool configured to store water. People usually carry a cup when they go out, and can drink water if needed. The cup is usually composed of a container main body and a cup lid; a straw is arranged in the container main body. People can drink water with the straw. Currently, cups with two drinking openings have been invented on the market according to needs of different people for driving water. To be specific, people drink water through a direct drinking opening or a straw opening. However, the cup with two drinking openings on the market is usually provided with two upper lids covering the direct drinking opening and the straw opening respectively. A user needs to open different upper lids to select different drinking ways, and straws of these cups are basically stored by being pressed by the upper lids at their upper ends. If the straw is pressed for long time, the straw may not immediately pop up when the upper lid is opened. The user needs to manually straighten the straw. Therefore, a cup with a straw that can automatically pop up vertically when people select to drink water through a straw opening.

SUMMARY

The present disclosure aims to provide a cup that is simple in structure. A straw of the cup can automatically pop up vertically when people select to drink water through a straw opening.

The objective of the present disclosure is achieved below:

A container lid with two drinking openings includes:

- a lid body, which is configured to be attached to a container main body;
- a direct drinking opening, which is arranged on the lid body, wherein the direct drinking opening is communicated to the container main body, and a material stored in the container main body is directly drunk through the direct drinking opening;
- a straw opening, which is arranged on the lid body;
- a straw, which is movably arranged in the straw opening;
- a closure member, which is movably connected to the lid body and is configured to selectively cover the direct drinking opening and the straw opening, wherein the closure member can move between a first position covering the direct drinking opening and the straw opening and a second position not covering the direct drinking opening and the straw opening;
- a button, which is movably connected to the lid body and is configured to selectively keep the closure member in the first position, wherein the button can move between a locked position and an unlocked position relative to the lid body and the closure member; and
- a straw locking member, which is operably arranged on the lid body and is configured to: selectively store the straw in the locked position inside the straw opening and allow the straw to move between the locked position and an unlocked position where the straw extends out of the straw opening.

Further, the container lid with the two drinking openings includes a straw guide member, wherein the straw guide member is detachably connected to the lid body, and a channel which is roughly coaxial with the straw opening and allows the straw to move is arranged on the straw guide member.

Further, an avoidance portion for allowing the straw locking member to pass through is arranged on the straw guide member; and a clamping slot is provided at a position, corresponding to the avoidance portion, on the straw.

Further, the straw locking member includes a control member, a locking member, and a reset member; the control member protrudes out of the lid body for user operation; and the locking member is detachably connected to the lid body, and is movably combined with the straw under the action of the reset member.

Further, a first inclined surface is arranged on the locking member; a second inclined surface that is matched with the first inclined surface is arranged on the control member; a protrusion is further arranged on the locking member; the protrusion cooperates with the clamping slot on the straw to store the straw in the straw opening; and when the control member is pressed, the second inclined surface and the first inclined surface are combined to overcome an acting force of the reset member, so that the straw is unlocked and can extend out of the straw opening.

Further, the container lid with the two drinking openings includes a straw limiting member; the straw limiting member is fixedly connected to the straw in an adjustable manner and is located in the straw opening; and a size of the straw limiting member is greater than the straw opening, thereby controlling an extending amount of straw extending out of the straw opening.

Further, a first elastic member is arranged between the straw limiting member and the straw guide member; and the first elastic member promotes the straw to extend out of the straw opening and prevents the straw from easily retracting back into the straw opening during use by a user.

Further, a first sealing member is arranged between the control member and the lid body; and the first sealing member seals the control member and the container main body under the action of a force generated by the combination of the first inclined surface and the second inclined surface.

Further, the closure member is rotatably connected to the lid body through a rotating shaft; a second sealing member is arranged at a position, corresponding to the direct drinking opening and the straw opening, on the closure member; the second sealing member is arranged in the closure member in an interference manner; and a second elastic member for keeping the closure member in an open state is arranged between the rotating shaft and the lid body.

Further, a locking boss is further arranged at one end of the closure member away from the rotating shaft; a duct is arranged on the locking boss; a hole for allowing the locking boss to pass through is arranged on the lid body; a second locking member is arranged on the button; and when the second locking member passes through the hole, the closure member is locked on the lid body.

Further, a handle that is rotated between a storage position and an opening position is further arranged on the lid body, and a rotating shaft of the handle and a rotating shaft of the closure member are coaxially arranged.

Further, an avoidance stage is further arranged on the lid body; the avoidance stage provides a space when the handle is in a storage position; and a shape of the avoidance stage is matched with a shape of the handle, so that the entire lid body appears as a complete whole when the handle is in a stored state.

Further, a groove for making the handle located at the storage position is arranged on the button; and when the handle is in the storage position, movement of the button towards an unlocking direction is restricted to avoid accidental opening of the closure member due to a misoperation.

Further, a third elastic member is arranged between the button and the lid body, and the third elastic member provides a force for the button to be in a locked state.

Further, a hole for allowing the control member on the straw locking member to pass through is provided on the closure member.

Compared with the prior art, the present disclosure has outstanding and beneficial technical effects:

The present disclosure relates to a container lid with two drinking openings, including: a lid body, which is configured to be attached to a container main body; a direct drinking opening, which is arranged on the lid body, wherein the direct drinking opening is communicated to the container main body, and a material stored in the container main body can be directly drunk through the direct drinking opening; a straw opening, which is arranged on the lid body; a straw, which is movably arranged in the straw opening; a closure member, which is movably connected to the lid body and is configured to selectively cover the direct drinking opening and the straw opening, wherein the closure member can move between a first position covering the direct drinking opening and the straw opening and a second position not covering the direct drinking opening and the straw opening; a button, which is movably connected to the lid body and is configured to selectively keep the closure member in the first position, wherein the button can move between a locked position and an unlocked position relative to the lid body and the closure member; and a straw locking member, which is operably arranged on the lid body and is configured to: selectively store the straw in the locked position inside the straw opening and allow the straw to move between the locked position and an unlocked position where the straw extends out of the straw opening. A cup with two drinking openings on the market is usually provided with two upper lids covering the direct drinking opening and the straw opening respectively. A user needs to open different upper lids to select different drinking ways, and straws of these cups are basically stored by being pressed by the upper lids at their upper ends. If the straw is pressed for long time, the straw may not immediately pop up when the upper lid is opened. The user needs to manually straighten the straw. In the present disclosure, the movement of the straw is restricted by the straw locking member to achieve separate selection of the direct drinking opening and the straw opening. People can directly drink the material stored in the container main body through the direct drinking opening, and can select to drink liquid in the container main body without lifting the container main body through the movable straw. When the cup is not used, people can close the direct drinking opening and the straw opening through the closure member to avoid water in the container main body from flowing out from the direct drinking opening and the straw opening. Furthermore, contact between the outside and the interior of the container main body can be further avoided. The closure member is opened through the button. It is convenient to press the button and is in line with the habit of modern people to open the lid. After a user presses the button, the closure member may be opened. At this time, the closure member does not cover the direct drinking opening, and the user directly drinks water. To use the straw opening, the straw locking member is controlled to release the straw. At this time, the straw can move upwards and be exposed with floatage, and the user drinks water with the straw. The cup is convenient and quick to use, can be quickly opened if people intend to drink water, and is easy to operate. This product is clean and sanitary because people will not touch the straw.

MEANINGS OF REFERENCE NUMERALS IN THE DRAWINGS

Figure 1:
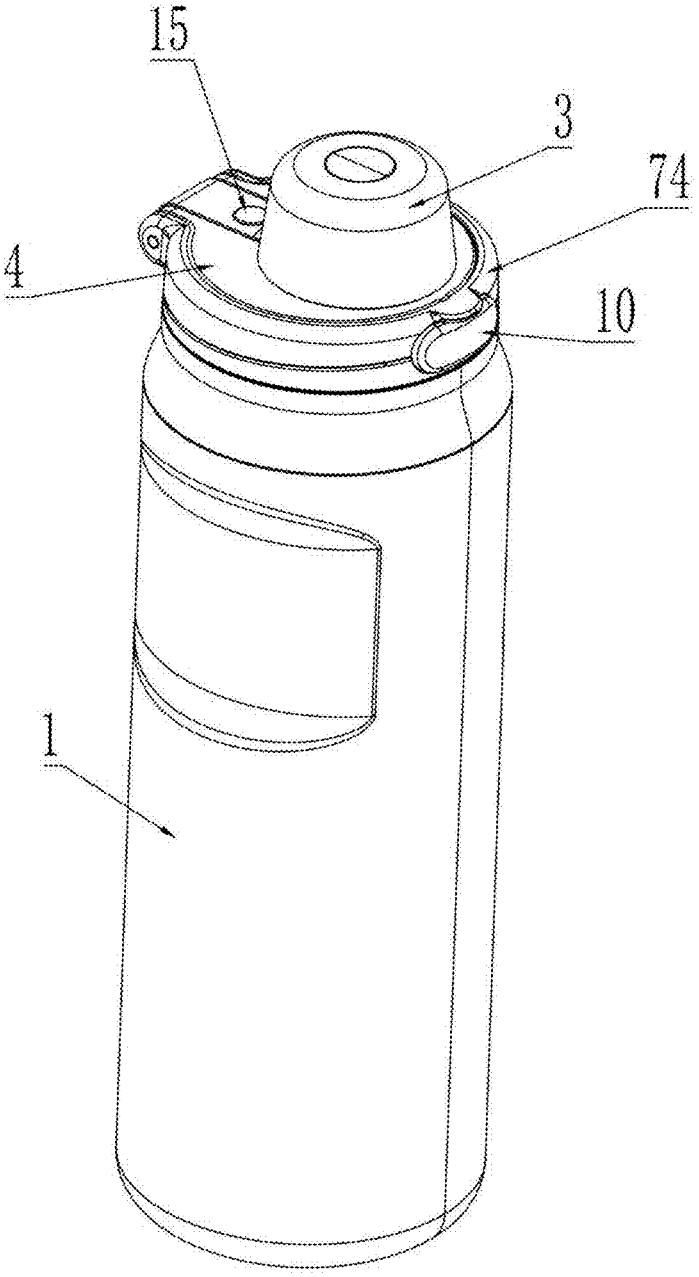
FIG. 1 is a three-dimensional diagram of the present disclosure.
Figure 2:
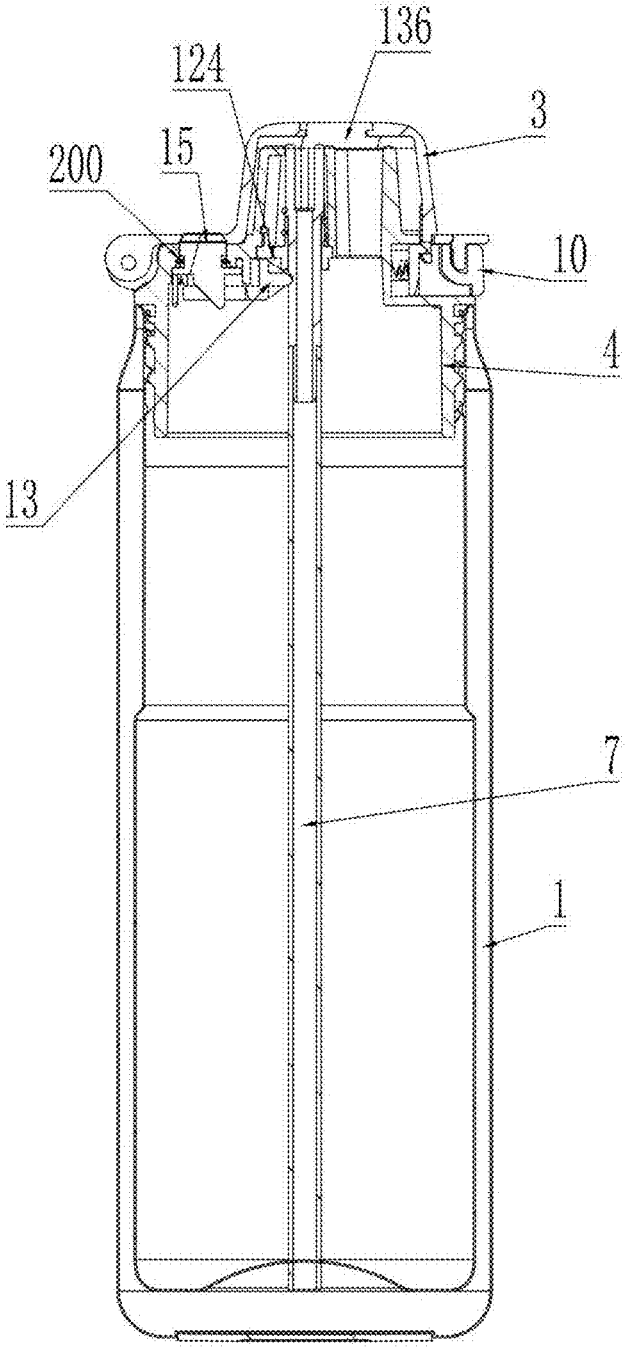
FIG. 2 is cross-sectional view of the present disclosure.
Figure 3:
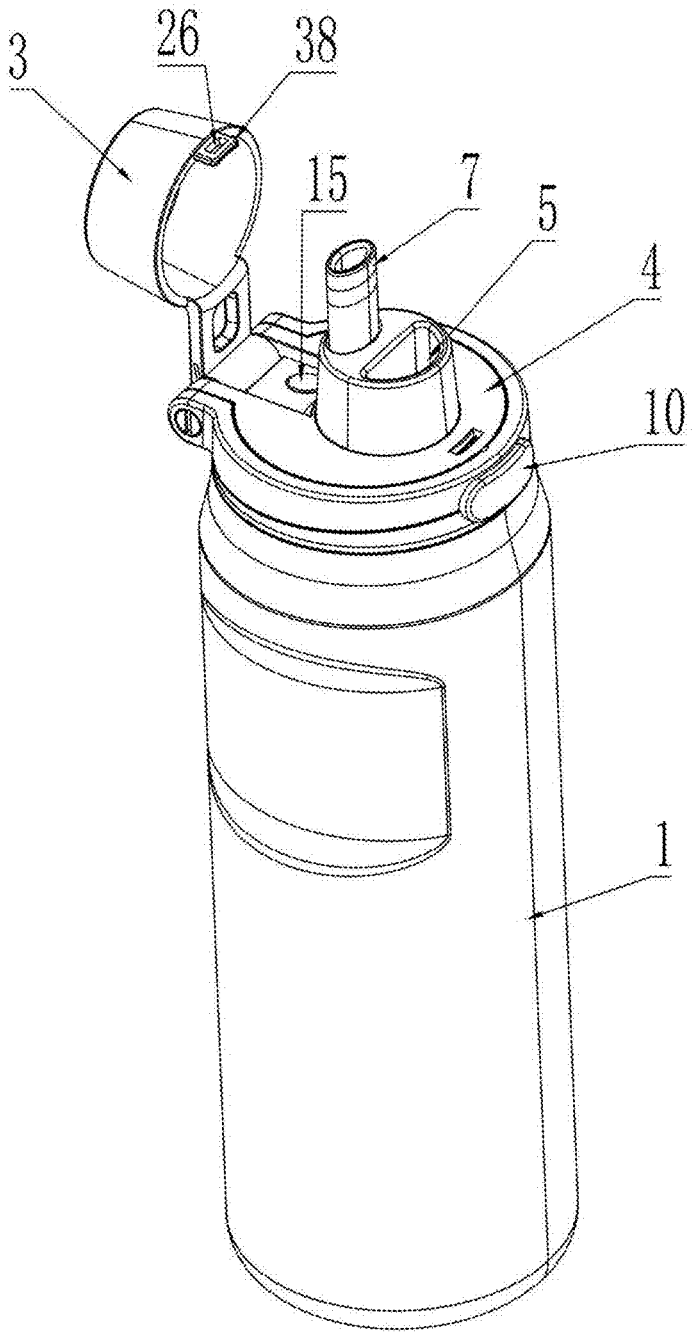
FIG. 3 is a schematic diagram of drinking with a straw according to the present disclosure.
Figure 4:
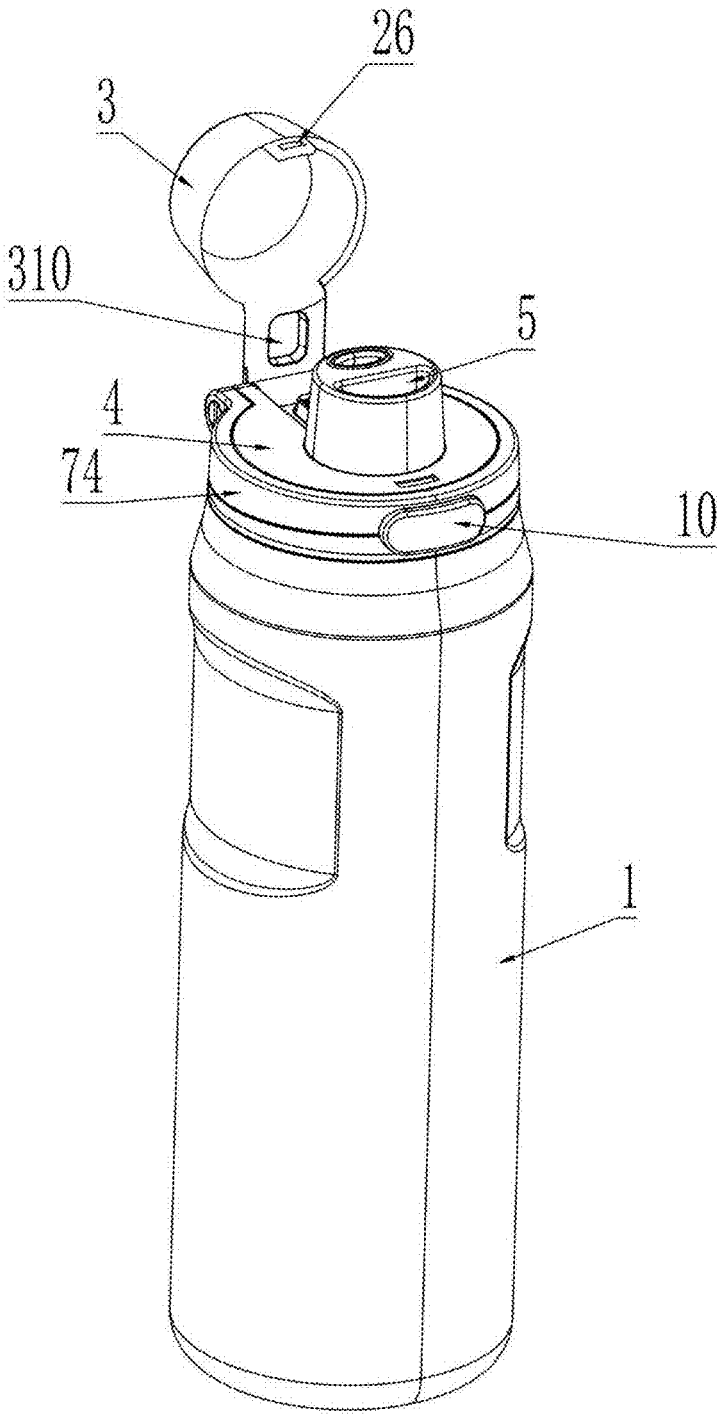
FIG. 4 is a schematic diagram of use of a direct drinking opening according to the present disclosure.
Figure 5:
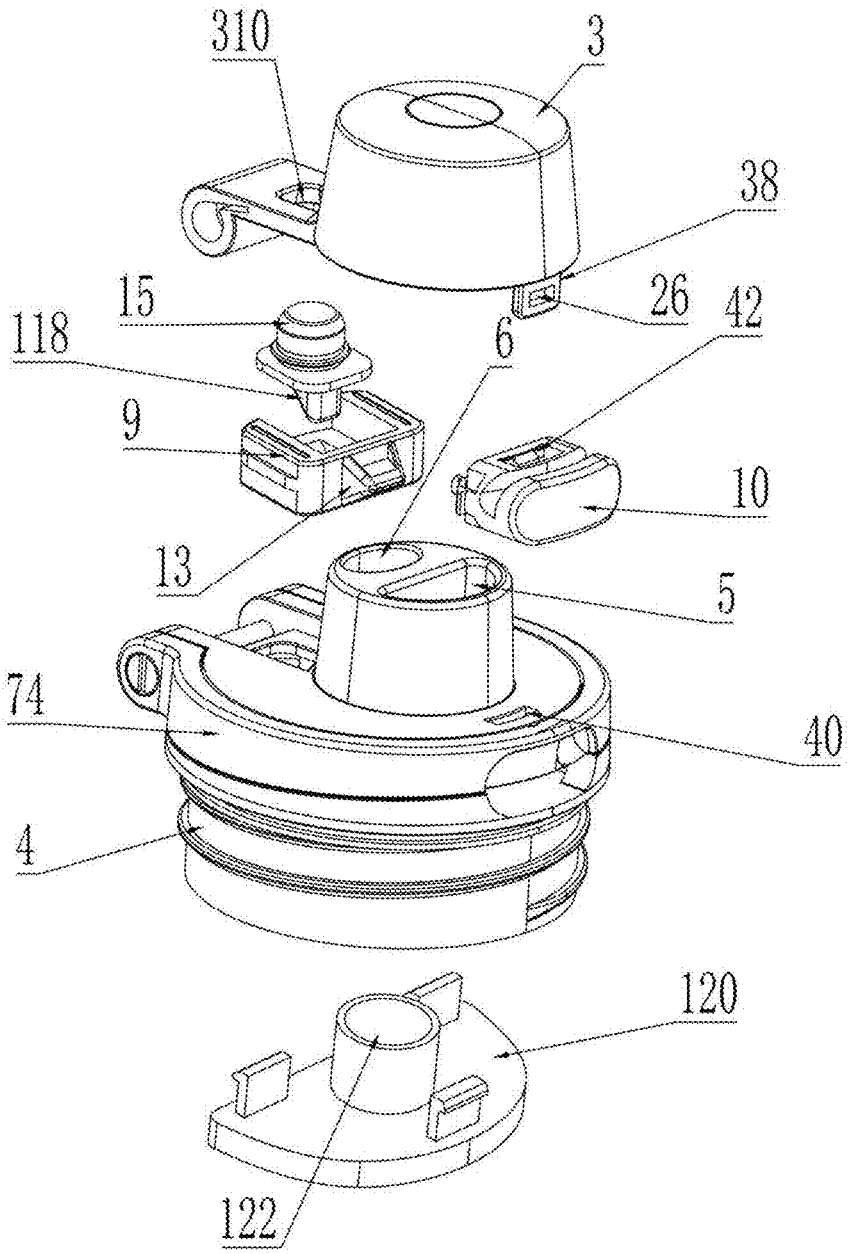
FIG. 5 is an exploded view of removing a container main body according to the present disclosure.
Figure 6:
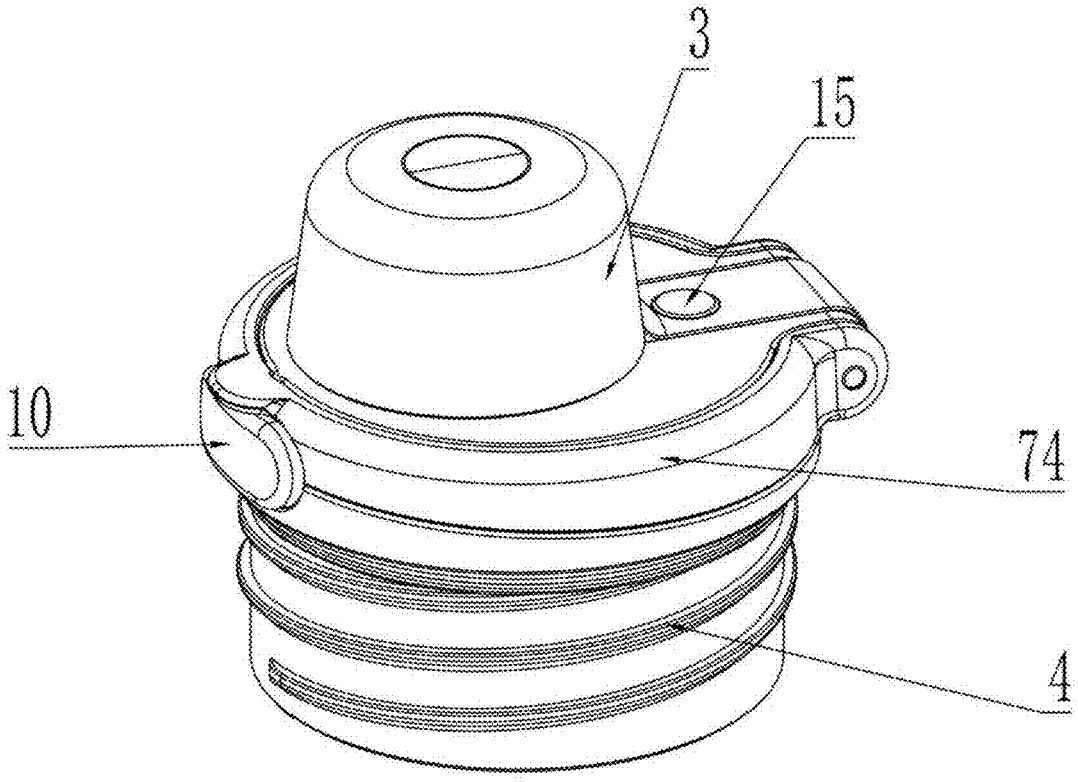
FIG. 6 is a three-dimensional diagram of removing a container main body according to the present disclosure.
Figure 7:
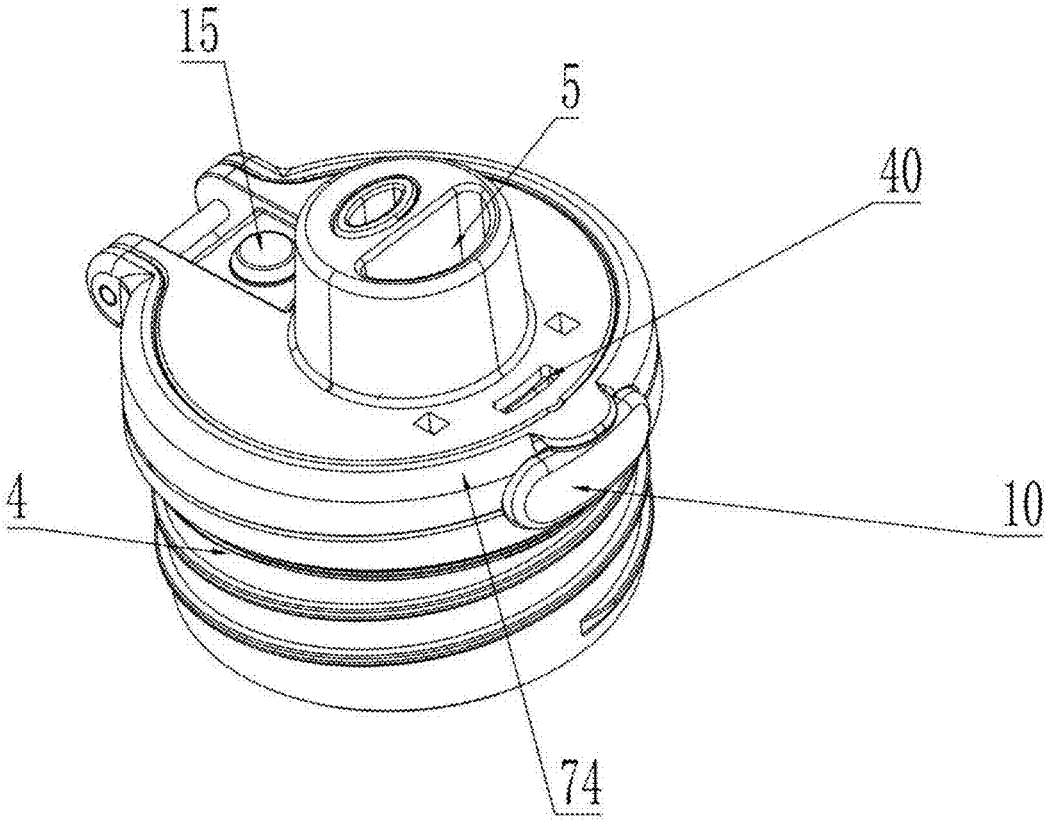
FIG. 7 is a three-dimensional diagram of removing a container main body and a closure member according to the present disclosure.
Figure 8:
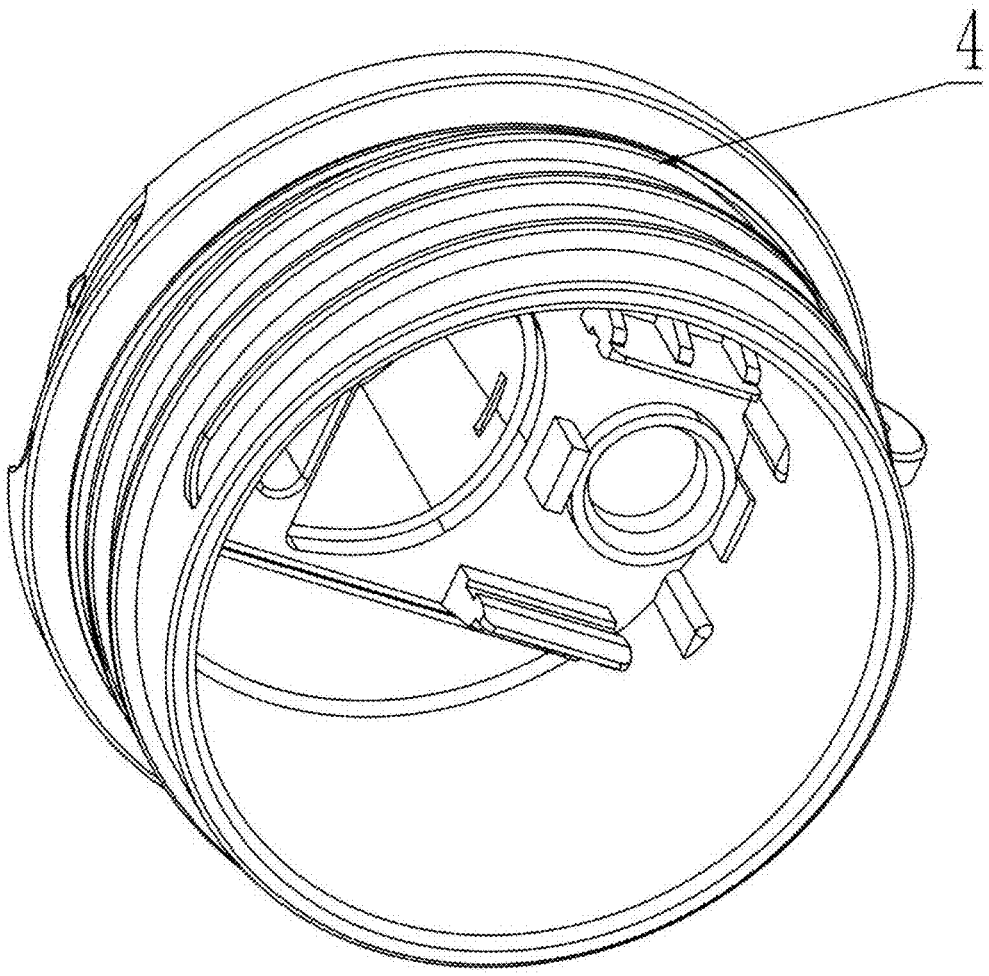
FIG. 8 is a three-dimensional diagram of a lid body of the present disclosure.
Figure 9:
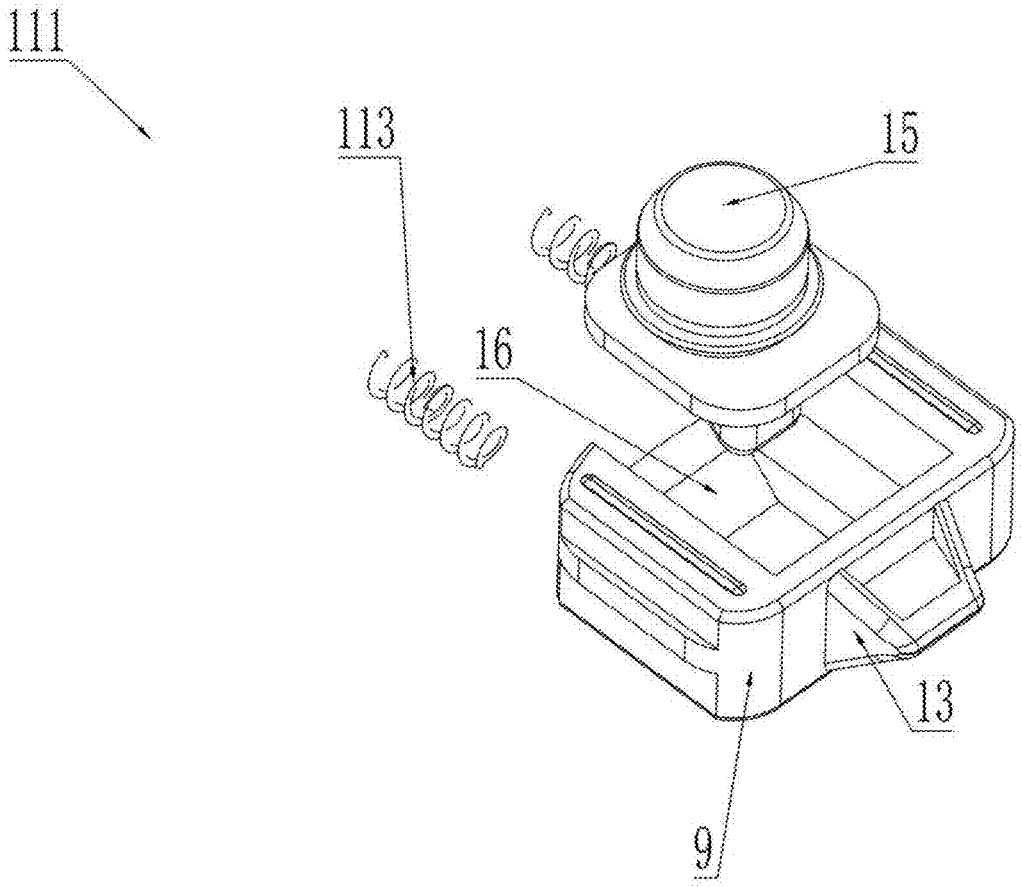
FIG. 9 is an exploded view of a straw locking member of the present disclosure.
Figure 10:
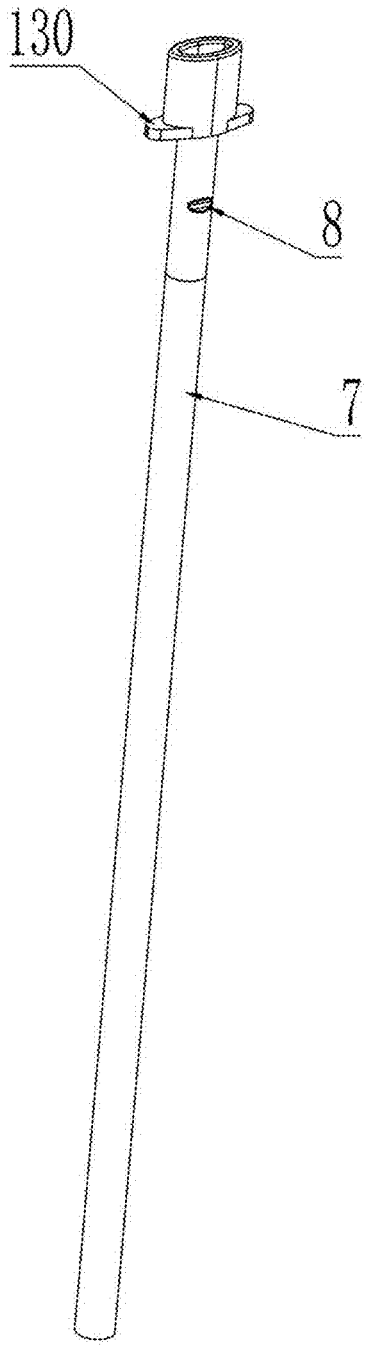
FIG. 10 is a three-dimensional diagram of a straw of the present disclosure.
Figure 11:
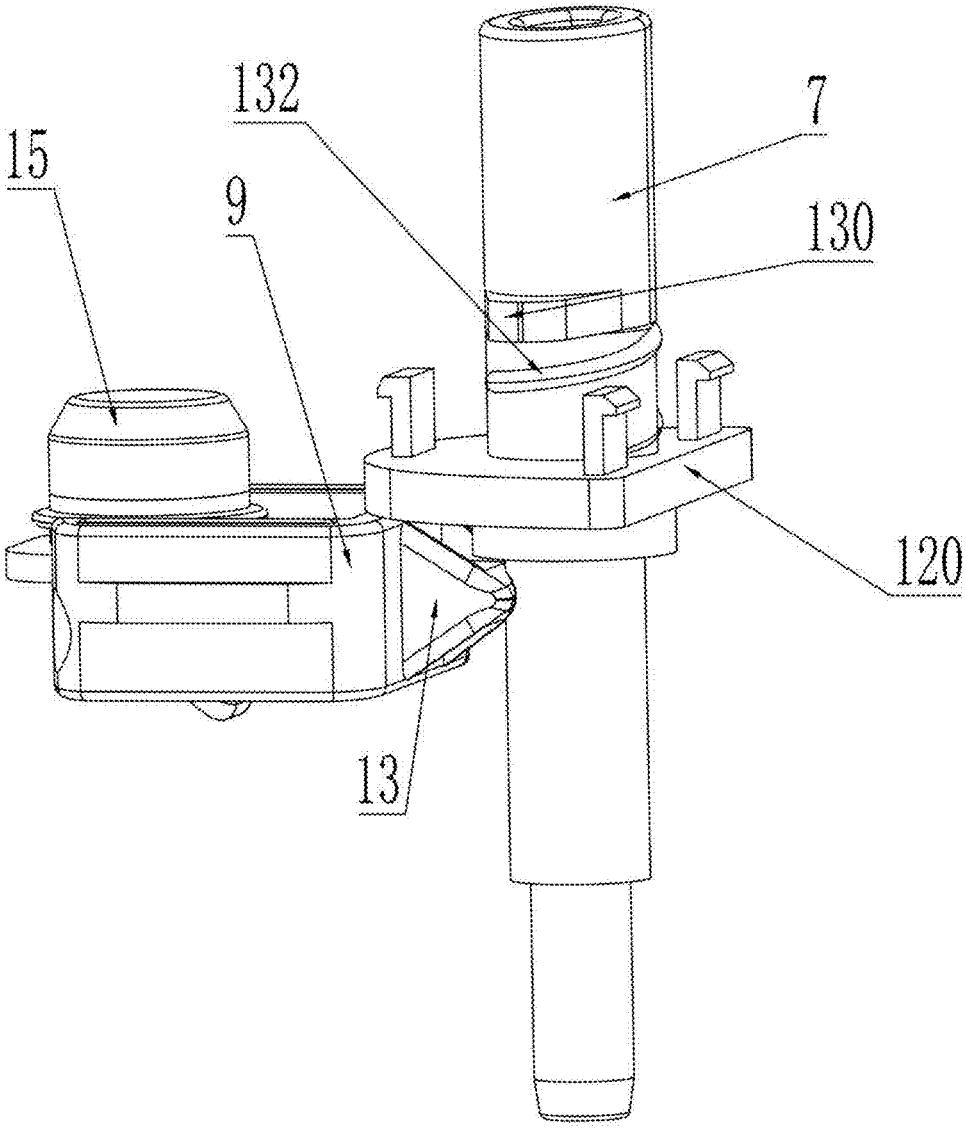
FIG. 11 is a three-dimensional diagram of a control member, a locking member, and a straw of the present disclosure.
Figure 12:
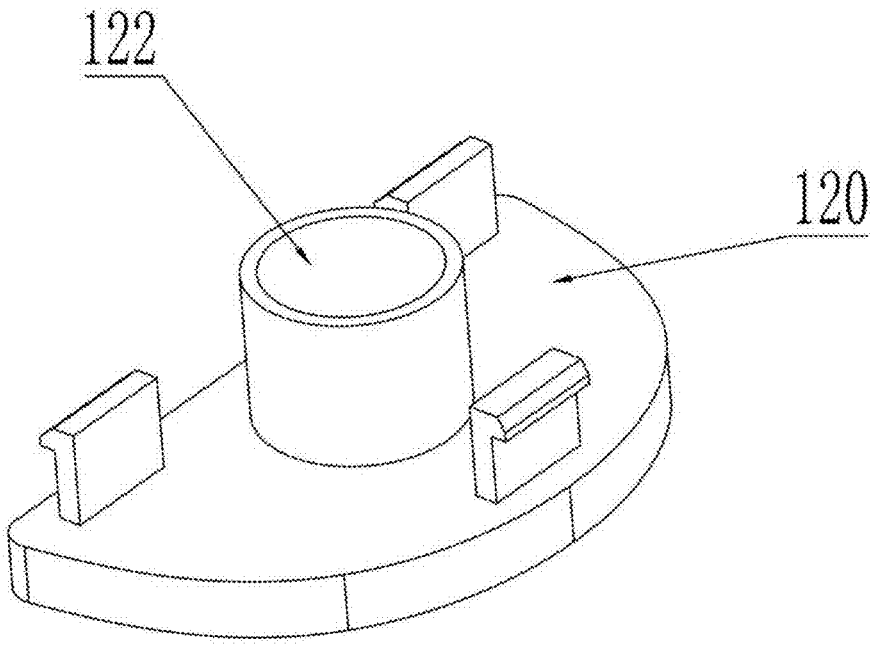
FIG. 12 is a three-dimensional diagram of a straw guide member of the present disclosure.
Figure 13:
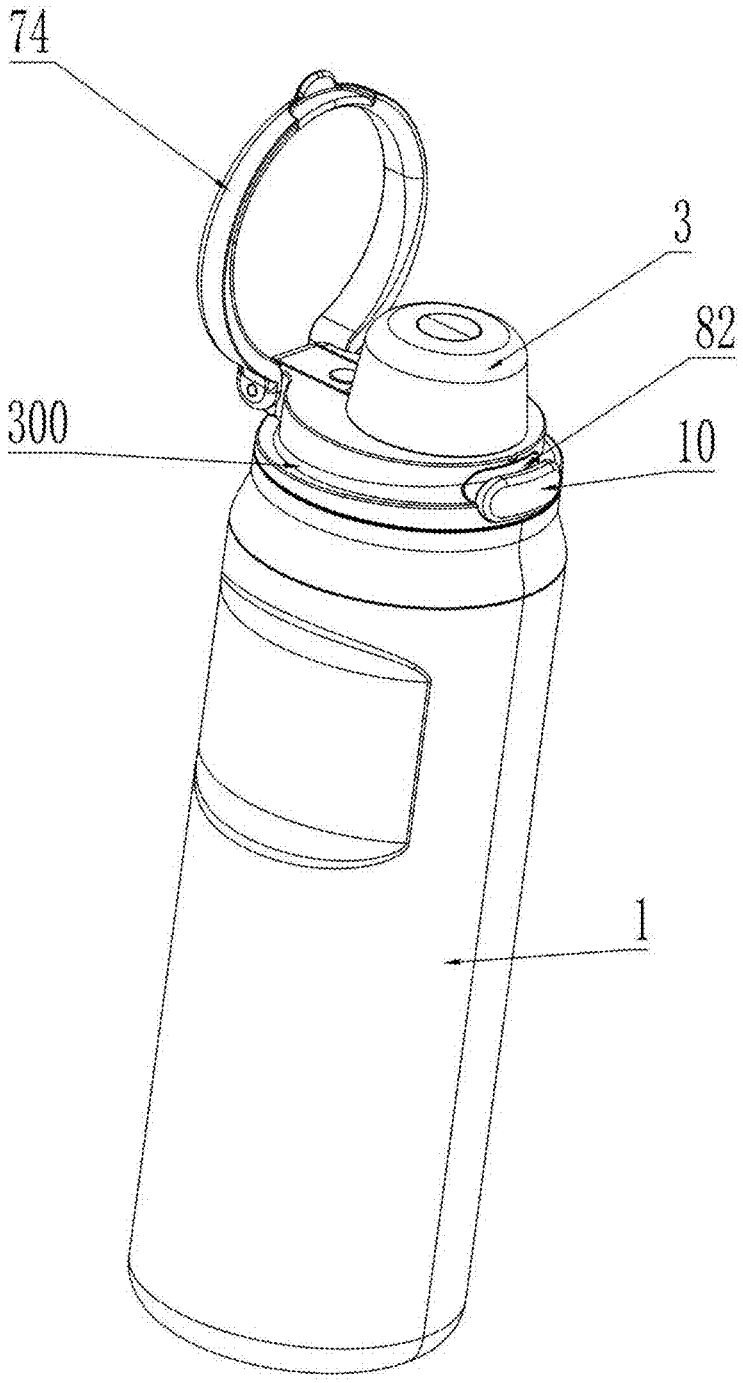
FIG. 13 is a schematic diagram of opening a handle of the present disclosure.
Figure 14:
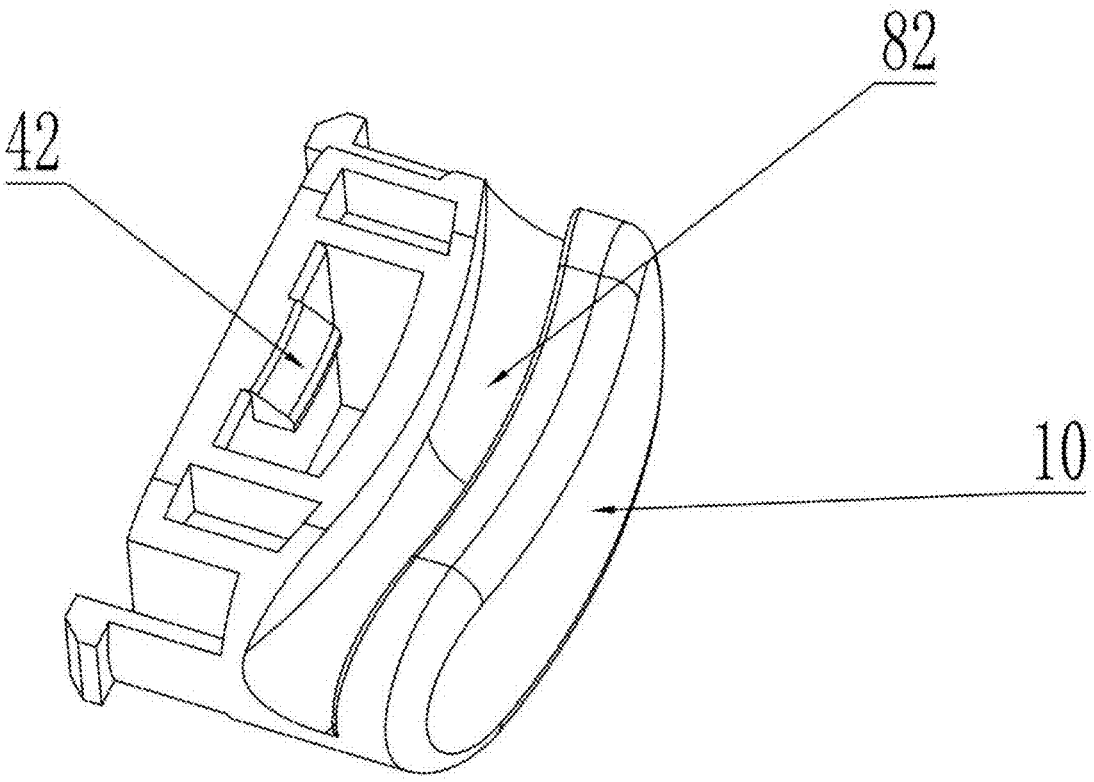
FIG. 14 is a three-dimensional diagram of a button of the present disclosure.

1: container main body; 3: closure member; 4: lid body; 5: direct drinking opening; 6: straw opening; 7: straw; 8: clamping slot; 9: locking member; 10: button; 13: protrusion; 15: control member; 16: first inclined surface; 26: duct; 38: locking boss; 40: hole; 42: second locking member; 74: handle; 82: groove; 90: third elastic member; 111: straw locking member; 113: reset member; 118: second inclined surface; 120: straw guide member; 122: channel;

124: avoidance portion; 130: straw limiting member; 132: first elastic member; 136: second sealing member;

200: first sealing member; 300: avoidance stage; and 310: hole.

DETAILED DESCRIPTION OF THE EMBODIMENTS

The present disclosure will be further described below in conjunction with specific embodiments.

A container lid with two drinking openings includes:

a lid body 4, which is configured to be attached to a container main body 1;

a direct drinking opening 5, which is arranged on the lid body 4, wherein the direct drinking opening 5 is communicated to the container main body 1, and a material stored in the container main body 1 can be directly drunk through the direct drinking opening 5;

a straw opening 6, which is arranged on the lid body 4;

a straw 7, which is movably arranged in the straw opening 6;

a closure member 3, which is movably connected to the lid body 4 and is configured to selectively cover the direct drinking opening 5 and the straw opening 6, wherein the closure member 3 can move between a first position covering the direct drinking opening 5 and the straw opening 6 and a second position not covering the direct drinking opening 5 and the straw opening 6;

a button 10, which is movably connected to the lid body 4 and is configured to selectively keep the closure member 3 in the first position, wherein the button 10 can move between a locked position and an unlocked position relative to the lid body 4 and the closure member 3; and a straw locking member 111, which is operably arranged on the lid body 4 and is configured to: selectively store the straw 7 in the locked position inside the straw opening 6 and allow the straw 7 to move between the locked position and an unlocked position where the straw extends out of the straw opening 6.

The present disclosure relates to a container lid with two drinking openings, including: a lid body, which is configured to be attached to a container main body; a direct drinking opening, which is arranged on the lid body, wherein the direct drinking opening is communicated to the container main body, and a material stored in the container main body can be directly drunk through the direct drinking opening; a straw opening, which is arranged on the lid body; a straw, which is movably arranged in the straw opening; a closure member, which is movably connected to the lid body and is configured to selectively cover the direct drinking opening and the straw opening, wherein the closure member can move between a first position covering the direct drinking opening and the straw opening and a second position not covering the direct drinking opening and the straw opening; a button, which is movably connected to the lid body and is configured to selectively keep the closure member in the first position, wherein the button can move between a locked position and an unlocked position relative to the lid body and the closure member; and a straw locking member, which is operably arranged on the lid body and is configured to: selectively store the straw in the locked position inside the straw opening and allow the straw to move between the locked position and an unlocked position where the straw extends out of the straw opening. A cup with two drinking openings on the market is usually provided with two upper lids covering the direct drinking opening and the straw opening respectively. A user needs to open different upper lids to select different drinking ways, and straws of these cups are basically stored by being pressed by the upper lids at their upper ends. If the straw is pressed for long time, the straw may not immediately pop up when the upper lid is opened. The user needs to manually straighten the straw. In the present disclosure, the movement of the straw is restricted by the straw locking member to achieve separate selection of the direct drinking opening and the straw opening. People can directly drink the material stored in the container main body 1 through the direct drinking opening, and can select to drink liquid in the container main body 1 without lifting the container main body 1 through the movable straw. When the cup is not used, people can close the direct drinking opening and the straw opening through the closure member to avoid water in the container main body 1 from flowing out from the direct drinking opening and the straw opening. Furthermore, contact between the outside and the interior of the container main body 1 can be further avoided. The closure member is opened through the button. It is convenient to press the button and is in line with the habit of modern people to open the lid. After a user presses the button, the closure member may be opened. At this time, the closure member does not cover the direct drinking opening, and the user directly drinks water. To use the straw opening, the straw locking member is controlled to release the straw. At this time, the straw can move upwards and be exposed with floatage, and the user drinks water with the straw. The cup is convenient and quick to use, can be quickly opened if people intend to drink water, and is easy to operate. This product is clean and sanitary because people will not touch the straw.

Preferably, the container lid with the two drinking openings further includes a straw guide member 120, wherein the straw guide member 120 is detachably connected to the lid body 4, and a channel 122 which is roughly coaxial with the straw opening 6 and allows the straw to move is arranged on the straw guide member 120. The straw guide member restricts a movement direction of the straw to avoid the straw from moving towards other directions. This achieves a guide effect.

Preferably, an avoidance portion 124 for allowing the straw locking member 111 to pass through is arranged on the straw guide member 120; and a clamping slot 8 is provided at a position, corresponding to the avoidance portion 124, on the straw 7. The clamping slot is configured to clamp the straw locking member to restrict the straw from moving; when the straw locking member is separated from the clamping slot, the straw can move; and the avoidance portion is a space, which is convenient for the straw locking member to move and pass through.

Preferably, the straw locking member 111 includes a control member 15, a locking member 9, and a reset member 113; the control member 15 protrudes out of the lid body 4 for user operation; and the locking member 9 is detachably connected to the lid body 4, and is movably combined with the straw 7 under the action of the reset member 113. Pressing the control member can control the locking member 9 to move. When a user releases the control member 15, the locking member 9 returns to an original position through the reset member 113. The connection is simple and ingenious.

Preferably, a first inclined surface 16 is arranged on the locking member 9; a second inclined surface 118 that is matched with the first inclined surface 16 is arranged on the control member 15; a protrusion 13 is further arranged on the locking member 9; the protrusion 13 cooperates with the clamping slot 8 on the straw 7 to store the straw 7 in the straw opening 6; and when the control member 15 is pressed, the second inclined surface 118 and the first inclined surface 16 are combined to overcome an acting force of the reset member 113, so that the straw 7 is unlocked and can extend out of the straw opening 6. Through the interaction force between the second inclined surface 118 on the control member 15 and the first inclined surface 16 on the locking member 9, when the control member 15 is pressed downwards, the locking member 9 is forced to move through a relative force. The protrusion 13 on the locking member 9 is then separated from the clamping slot 8 with the movement of the locking member 9. At this time, the straw moves upwards, the control member is released, and the locking member is reset through the reset member.

Preferably, the container lid with the two drinking openings further includes a straw limiting member 130; the straw limiting member 130 is fixedly connected to the straw 7 in an adjustable manner and is located in the straw opening 6; and a size of the straw limiting member is greater than the straw opening 7, thereby controlling an extending amount of straw 7 extending out of the straw opening 6. This avoids the straw from being separated from the straw opening. When the straw moves upwards, the straw limiting member resists against a lower surface of the straw opening.

Preferably, a first elastic member 132 is arranged between the straw limiting member 130 and the straw guide member 120; and the first elastic member 132 promotes the straw 7 to extend out of the straw opening 6 and prevents the straw 7 from easily retracting back into the straw opening 6 during use by a user. This avoids the straw from returning into the straw opening at the moment when the user releases the straw. A lower end of the first elastic member resists against the straw guide member, and an upper end resists against the straw limiting member to sleeve the straw.

Preferably, a first sealing member 200 is arranged between the control member 15 and the lid body 4; and the first sealing member 200 seals the control member 15 and the container main body 1 under the action of a force generated by the combination of the first inclined surface 16 and the second inclined surface 118. This avoids water from flowing out from the control member, and the sealing performance is better.

Preferably, the closure member 3 is rotatably connected to the lid body 4 through a rotating shaft; a second sealing member 136 is arranged at a position, corresponding to the direct drinking opening 5 and the straw opening 6, on the closure member 3; the second sealing member 136 is arranged in the closure member in an interference manner; and a second elastic member for keeping the closure member 3 in an open state is arranged between the rotating shaft and the lid body 4. The second elastic member can be a commonly used torsion spring for cups on the market, making it easy to rotate and open the closure member, which is in line with the habit of opening cup lids of modern people. The second sealing member can seal the direct drinking opening and the straw opening.

Preferably, a locking boss 38 is further arranged at one end of the closure member away from the rotating shaft; a duct 26 is arranged on the locking boss 38; a hole 40 for allowing the locking boss 38 to pass through is arranged on the lid body 4; a second locking member 42 is arranged on the button 10; and when the second locking member 42 passes through the hole 40, the closure member 3 is locked on the lid body 4. By matching between the locking boss and the hole, when the closure member is covered at the lid body, the locking boss is located inside the hole. At this time, the second locking member on the button hooks the locking boss, and the closure member cannot be opened. When the button is pressed, the second locking member moves along with the button. The second locking member is separated from the locking boss, and the closure member can be rotated to be opened.

Preferably, a handle 74 that is rotated between a storage position and an opening position is further arranged on the lid body 4, and a rotating shaft of the handle 74 and a rotating shaft of the closure member 3 are coaxially arranged. The coaxial arrangement saves the space. A user can carry the cup through the handle at any time.

Preferably, an avoidance stage 300 is further arranged on the lid body 4; the avoidance stage 300 provides a space when the handle 74 is in a storage position; and a shape of the avoidance stage 300 is matched with a shape of the handle 74, so that the entire lid body 4 appears as a complete whole when the handle is in a stored state. The handle and lid body are combined perfectly. Meanwhile, this facilitates mounting of the handle.

Preferably, a groove 82 for making the handle 74 located at the storage position is arranged on the button 10; and when the handle 74 is in the storage position, movement of the button 10 towards an unlocking direction is restricted to avoid accidental opening of the closure member 3 due to a misoperation. Accidental touch is avoided, thereby avoiding accidentally touching the button and opening the closure member, causing water to flow out. The safety is better. The button can be inwards pressed only when the handle is taken away from the avoidance stage and separated from the groove.

Preferably, a third elastic member 90 is arranged between the button 10 and the lid body 4, and the third elastic member 90 provides a force for the button 10 to be in a locked state. The third elastic member can drive the button to return to the original position after the button is pressed.

Preferably, a hole 310 for allowing the control member 15 on the straw locking member 111 to pass through is provided on the closure member 3. This facilitates the control member to protrude out and be pressed by a user.

The above embodiments are only preferred embodiments of the present disclosure, and do not limit the protection scope of the present disclosure. Therefore, any equivalent changes made on the basis of the structure, shape, and principle of the present disclosure shall all fall within the protection scope of the present disclosure.

What is claimed is:

1. A container lid with two drinking openings, comprising:

a lid body (4), which is configured to be attached to a container main body (1);

a direct drinking opening (5), which is arranged on the lid body (4), wherein the direct drinking opening (5) is communicated to the container main body (1), and a material stored in the container main body (1) is directly drunk through the direct drinking opening (5);

a straw opening (6), which is arranged on the lid body (4);

a straw (7), which is movably arranged in the straw opening (6);

a closure member (3), which is movably connected to the lid body (4) and is configured to selectively cover the direct drinking opening (5) and the straw opening (6), wherein the closure member (3) is able to move between a first position covering the direct drinking opening (5) and the straw opening (6) and a second position not covering the direct drinking opening (5) and the straw opening (6);

a button (10), which is movably connected to the lid body (4) and is configured to selectively keep the closure member (3) in the first position, wherein the button (10) is able to move between a locked position and an unlocked position relative to the lid body (4) and the closure member (3); and a straw locking member (111), which is operably arranged on the lid body (4) and is configured to: selectively store the straw (7) in the locked position inside the straw opening (6) and allow the straw (7) to move between the locked position and an unlocked position where the straw extends out of the straw opening (6).

2. The container lid with the two drinking openings according to claim 1, further comprising a straw guide member (120), wherein the straw guide member (120) is detachably connected to the lid body (4), and a channel (122) which is roughly coaxial with the straw opening (6) and allows the straw to move is arranged on the straw guide member (120).

3. The container lid with the two drinking openings according to claim 2, wherein an avoidance portion (124) for allowing the straw locking member (111) to pass through is arranged on the straw guide member (120); and a clamping slot (8) is provided at a position, corresponding to the avoidance portion (124), on the straw (7).

4. The container lid with the two drinking openings according to claim 1, wherein the straw locking member (111) comprises a control member (15), a locking member (9), and a reset member (113); the control member (15) protrudes out of the lid body (4) for user operation; and the locking member (9) is detachably connected to the lid body (4), and is movably combined with the straw (7) under the action of the reset member (113).

5. The container lid with the two drinking openings according to claim 4, wherein a first inclined surface (16) is arranged on the locking member (9); a second inclined surface (118) that is matched with the first inclined surface (16) is arranged on the control member (15); a protrusion (13) is further arranged on the locking member (9); the protrusion (13) cooperates with the clamping slot (8) on the straw (7) to store the straw (7) in the straw opening (6); and when the control member (15) is pressed, the second inclined surface (118) and the first inclined surface (16) are combined to generate a force that overcomes an acting force of the reset member (113), so that the straw (7) is unlocked and extends out of the straw opening (6).

6. The container lid with the two drinking openings according to claim 1, further comprising a straw limiting member (130), wherein the straw limiting member (130) is fixedly connected to the straw (7) in an adjustable manner and is located in the straw opening (6); and a size of the straw limiting member is greater than the straw opening (7), thereby controlling an extending amount of straw (7) extending out of the straw opening (6).

7. The container lid with the two drinking openings according to claim 6, wherein a first elastic member (132) is arranged between the straw limiting member (130) and the straw guide member (120); and the first elastic member (132) promotes the straw (7) to extend out of the straw opening (6) and prevents the straw (7) from easily retracting back into the straw opening (6) during use by a user.

8. The container lid with the two drinking openings according to claim 1, wherein a first sealing member (200) is arranged between the control member (15) and the lid body (4); and the first sealing member (200) seals the control member (15) and the container main body (1) under the action of a force generated by the combination of the first inclined surface (16) and the second inclined surface (118).

9. The container lid with the two drinking openings according to claim 1, wherein the closure member (3) is rotatably connected to the lid body (4) through a rotating shaft; a second sealing member (136) is arranged at a position, corresponding to the direct drinking opening (5) and the straw opening (6), on the closure member (3); the second sealing member (136) is arranged in the closure member in an interference manner; and a second elastic member for keeping the closure member (3) in an open state is arranged between the rotating shaft and the lid body (4).

10. The container lid with the two drinking openings according to claim 1, wherein a locking boss (38) is further arranged at one end of the closure member away from the rotating shaft; a duct (26) is arranged on the locking boss (38); a hole (40) for allowing the locking boss (38) to pass through is arranged on the lid body (4); a second locking member (42) is arranged on the button (10); and when the second locking member (42) passes through the hole (40), the closure member (3) is locked on the lid body (4).

11. The container lid with the two drinking openings according to claim 1, wherein a handle (74) that is rotated between a storage position and an opening position is further arranged on the lid body (4), and a rotating shaft of the handle (74) and a rotating shaft of the closure member (3) are coaxially arranged.

12. The container lid with the two drinking openings according to claim 1, wherein an avoidance stage (300) is further arranged on the lid body (4); the avoidance stage (300) provides a space when the handle (74) is in a storage position; and a shape of the avoidance stage (300) is matched with a shape of the handle (74), so that the entire lid body (4) appears as a complete whole when the handle is in a stored state.

13. The container lid with the two drinking openings according to claim 1, wherein a groove (82) for making the handle (74) located at the storage position is arranged on the button (10); and when the handle (74) is in the storage position, movement of the button (10) towards an unlocking direction is restricted to avoid accidental opening of the closure member (3) due to a misoperation.

14. The container lid with the two drinking openings according to claim 1, wherein a third elastic member (90) is arranged between the button (10) and the lid body (4), and the third elastic member (90) provides a force for the button (10) to be in a locked state.

15. The container lid with the two drinking openings according to claim 1, wherein a hole (310) for allowing the control member (15) on the straw locking member (111) to pass through is provided on the closure member (3).

* * * * *